US007506776B2

(12) United States Patent
Podd

(10) Patent No.: US 7,506,776 B2
(45) Date of Patent: Mar. 24, 2009

(54) BRACELESS LINER

(75) Inventor: Stephen D. Podd, Rouses Point, NY (US)

(73) Assignee: Powertex, Inc., Rouses Point, NY (US)

( * ) Notice: Subject to any disclaimer, the term of this patent is extended or adjusted under 35 U.S.C. 154(b) by 746 days.

(21) Appl. No.: 11/055,555

(22) Filed: Feb. 10, 2005

(65) Prior Publication Data

US 2006/0175324 A1 Aug. 10, 2006

(51) Int. Cl.
*B65D 88/00* (2006.01)
*B65D 25/14* (2006.01)
*B65D 35/14* (2006.01)

(52) U.S. Cl. ..... 220/1.6; 220/495.01; 220/495.06; 220/495.07

(58) Field of Classification Search ..... 220/495.01, 220/495.06, 495.07, 1.5; 229/117.27; 383/119
See application file for complete search history.

(56) References Cited

U.S. PATENT DOCUMENTS

| | | | |
|---|---|---|---|
| 1,815,653 | A | 7/1931 | Jones |
| 2,144,181 | A | 1/1939 | Du Bois |
| 2,626,885 | A | 1/1953 | Gollings |
| 2,712,797 | A | 7/1955 | Woehrle et al. |
| 2,748,673 | A | 6/1956 | Winstead |
| 2,896,839 | A | 7/1959 | Barnes et al. |
| 2,956,839 | A | 10/1960 | Hermanns |
| 2,989,213 | A | 7/1961 | Daggitt |
| 3,044,653 | A | 7/1962 | Tantlinger |
| 3,061,133 | A | 10/1962 | Reynolds |
| 3,085,707 | A | 4/1963 | Tantlinger |
| 3,087,491 | A | 4/1963 | Gewecke et al. |
| 3,087,759 | A | 4/1963 | Worster |
| 3,105,617 | A | 10/1963 | Felldin |
| 3,163,544 | A | 12/1964 | Valyi |
| 3,167,209 | A | 1/1965 | Jones |

(Continued)

FOREIGN PATENT DOCUMENTS

| | | |
|---|---|---|
| BE | 650159 | 3/1964 |

(Continued)

*Primary Examiner*—Anthony D Stashick
*Assistant Examiner*—Shawn M Braden
(74) *Attorney, Agent, or Firm*—Turner Padget Graham & Laney, P.A.

(57) ABSTRACT

A container system having a bulkhead liner and method of using the bulkhead liner includes a pliable body with an exterior surface and an interior surface forming a cavity therein. At least one loading aperture is formed through the exterior and interior surfaces for loading a product in the cavity. When filled with the product, the pliable body substantially assumes a shape complementary to the shipping container shape. In one aspect of the invention, a lattice having a plurality of straps is affixed to the exterior surface to resist an expansion force exerted by the product from within the cavity. At least one load-bearing band is situated within the cavity of the pliable body shrouded by a sheath to protect the product from contamination by external elements to which the load-bearing band may be exposed. The load-bearing band is freely movable within the sheath to prevent damage to the pliable body when the product fills the cavity and imparts an expansion force against the pliable body. The load-bearing band is attached to a portion of the lattice to provide additional resistance against the expansion force exerted by the product in the cavity.

26 Claims, 7 Drawing Sheets

U.S. PATENT DOCUMENTS 3,170,600 A 2/1965 Pierson
3,171,449 A 3/1965 Ellms et al.
3,173,573 A 3/1965 Donegan
3,199,726 A 8/1965 Pierson
3,201,000 A 8/1965 Hermanns
3,235,432 A 2/1966 George
3,272,373 A 9/1966 Alleaume et al.
3,273,761 A 9/1966 Langen
3,275,197 A 9/1966 Eklund
3,309,007 A 3/1967 Rosenburg et al.
3,351,235 A 11/1967 Paton
3,356,251 A 12/1967 Roberts
3,384,106 A 5/1968 Isbrandtsen
3,386,605 A 6/1968 Lafont
3,393,835 A 7/1968 Kantor
3,421,665 A 1/1969 Paton
3,477,610 A 11/1969 Hansen
3,574,332 A 4/1971 Wetzel
3,578,213 A 5/1971 Clarke
3,583,330 A 6/1971 Freudman
3,590,888 A 7/1971 Coleman
3,604,578 A 9/1971 Smith
3,696,952 A 10/1972 Bodenheimer
3,726,067 A 4/1973 Fesco
3,756,469 A 9/1973 Clark et al.
3,762,341 A 10/1973 Alder
3,941,258 A 3/1976 Ide
3,951,284 A 4/1976 Fell et al.
3,978,996 A 9/1976 Oltrogge
3,980,196 A * 9/1976 Paulyson et al. ..... 220/1.5
4,054,226 A 10/1977 Bjelland et al.
4,124,136 A 11/1978 Bjelland et al.
4,170,946 A 10/1979 Youness
4,186,845 A 2/1980 Podd
4,230,061 A 10/1980 Roberts et al.
4,232,803 A 11/1980 Muller et al.
4,251,013 A 2/1981 Krause
4,334,812 A 6/1982 Delatush
4,345,862 A 8/1982 Blout et al.
4,358,233 A 11/1982 Morris et al.
4,385,953 A 5/1983 Beck
4,394,966 A 7/1983 Snyder et al.
4,399,737 A 8/1983 Severson
4,421,250 A 12/1983 Bonerb et al.
4,441,627 A 4/1984 Takeuchi
4,441,678 A 4/1984 Dorpmund
4,461,402 A 7/1984 Fell et al.
4,470,749 A 9/1984 Koudstaal
4,498,824 A 2/1985 Kinkle
4,556,349 A 12/1985 Koudstaal et al.
4,595,126 A 6/1986 Holmes
4,629,390 A 12/1986 Burke
4,635,814 A 1/1987 Jones
4,673,112 A 6/1987 Bonerb
4,701,087 A 10/1987 Cain et al.
4,784,287 A 11/1988 Yamada et al.
4,785,958 A 11/1988 Snyder
4,799,607 A 1/1989 Podd
4,854,801 A 8/1989 Bonerb
4,884,722 A 12/1989 Podd
4,911,317 A 3/1990 Schloesser et al.
4,913,321 A 4/1990 Abboud
4,960,227 A 10/1990 Coleman
5,010,943 A 4/1991 Boyer
5,040,693 A 8/1991 Podd, Sr. et al.
5,059,084 A 10/1991 Krein
5,069,352 A 12/1991 Harbolt et al.
5,110,000 A 5/1992 Nichols
5,152,735 A 10/1992 Podd, Jr. et al.
5,156,268 A 10/1992 Nichols
5,167,472 A 12/1992 Podd, Sr. et al.
5,181,625 A 1/1993 Podd, Sr. et al.
5,188,252 A 2/1993 Gerhard
5,193,710 A 3/1993 Podd, Sr. et al.
5,217,184 A 6/1993 Hararat-Tehrani
5,465,865 A 11/1995 Coombes
5,524,781 A 6/1996 Podd et al.
5,673,664 A 10/1997 Lassanske
5,688,086 A 11/1997 Menzemer et al.
5,738,240 A 4/1998 Vavra et al.
5,836,472 A 11/1998 Vavra et al.
6,012,598 A 1/2000 Antoniou
6,206,623 B1 3/2001 Podd
6,250,488 B1 * 6/2001 Narahara et al. ..... 220/1.6
6,286,700 B1 9/2001 Davidson
6,398,053 B1 6/2002 Thornsen
6,481,598 B1 11/2002 Thornsen
6,527,134 B2 3/2003 Hinkle et al.
6,637,469 B2 10/2003 Hoffman et al.

FOREIGN PATENT DOCUMENTS

CA 948039 5/1974
CA 1205106 5/1986
DE 2027842 1/1971
DE 2161631 6/1973
EP 0276994 3/1988
FR 2512790 3/1983
GB 1089874 11/1963
GB 1241162 7/1971
GB 2072618 10/1981
GB 2110192 7/1983

* cited by examiner

BRACELESS LINER

FIELD OF THE INVENTION

This invention relates to a liner system for a shipping container.

BACKGROUND OF THE INVENTION

Cargo containers are used to carry bulk cargo such as dry bulk chemicals, powdered and pelletized resins, flour, coffee, grains and the like. When cargo containers are used to carry bulk cargo, the container must be kept clean or be cleaned after each load of cargo is emptied from the container, so that the container can be subsequently used with another load of cargo. Moreover, the cargo must be protected from contamination and from undesirable exposure to natural elements.

Removable liners typically are used to line interior walls or surfaces of the cargo containers in order to carry the bulk cargo without sullying the container and contaminating the cargo. Such a liner protects the cargo during shipment or storage from rain, debris, and the like. After the cargo is delivered, the liner can be removed so that the container is again useable without significant cleaning to carry another load of cargo.

The conventional liner is extremely susceptible to tears or ruptures under certain conditions. For example, the cargo container is often emptied of its cargo by opening its rear door and raising its front end to tilt and slide the cargo through the rear door of the cargo container. This sliding action places great stress on various points of the conventional liner. This stress can cause the liner to rupture, which results in spillage and contamination of the cargo. Additionally, the shifting cargo can cause the liner itself to slide through the rear door of the container and rupture over an edge of the cargo container or upon impact with the ground.

Mechanical braces have been used in an attempt to remedy the deficiencies of the conventional liner. These braces are attached to or near the liner at the rear door area of the cargo container to hold the liner in the container as the cargo is unloaded. However, the braces are cumbersome, bulky and can interfere with unloading the cargo. The braces ironically can damage the liner they are intended to protect as the discharging cargo presses the liner against the braces.

A liner for a cargo container that is resistant to forces imparted by the cargo or its movement, which will not tear at stress points and not contaminate the cargo, is needed in the industry.

BRIEF SUMMARY OF THE INVENTION

The present invention is directed to a shipping container liner or bulkhead liner for a cargo carrier that resists shear, expansion, and gravitational forces imparted by a cargo or product held in the bulkhead liner. The component parts of the bulkhead liner are simple and economical to manufacture, assemble and use. Other advantages of the invention will be apparent from the following description and the attached drawings, or can be learned through practice of the invention.

According to one aspect of the invention, a bulkhead liner for a shipping container includes a pliable or flexible body having an exterior surface or face and an interior surface or face formed about a void or cavity in the pliable body. One or more loading apertures are formed through the exterior and interior surfaces for loading cargo in the cavity. The cargo can be any bulk product such as grain, chemicals, powered and pelletized resins, flour, coffee, grains and the like, and some combinations of these bulk products.

The exterior surface complements the shipping container shape when the pliable body is filled with the product. The pliable body has a capacity of 20 to 50 cubic feet, for example, when filled with the product. However, the pliable body can be manufactured with different capacities and in different shapes according to specific shipping containers.

The bulkhead liner in this aspect includes a lattice affixed or attached to the exterior surface of the pliable body to resist an expansion force exerted by the product in the cavity. One or more load-bearing bands or internal straps are attached to a portion of the lattice from within the bulkhead liner to further resist the expansion force exerted by the product in the cavity. One or more sheaths are located in the cavity with the load-bearing band or bands disposed in the sheath or sheaths to separate the load-bearing band from the product. In one aspect, the sheath can be affixed to the interior surface of the pliable body but the load-bearing band passes freely through the sheath such that the sheath does not stress the interior surface when a load is applied to the load-bearing band.

The pliable body is made from polypropylene, polyethylene, or other durable and reusable materials, and combinations of these materials. Similarly, the sheath is made from polyethylene while the lattice and the load-bearing band are made of a synthetic fabric such as nylon.

The lattice is formed, for example, from a number of straps attached horizontally, vertically, diagonally, or combinations of these orientations, to the exterior surface of the pliable body. The straps of the lattice are at least attached to the exterior surface proximate a shipping container doorway.

The sheath is sealed, for example, between the exterior and interior surfaces, or at the interior surface to encase the load-bearing band and separate it from the product. The sheath extends from the exterior surface of the pliable body and has a termination opening through which the load-bearing band extends towards a shipping container tie-down where the load-bearing band is attached. In one embodiment, the bulkhead liner includes at least four sheaths and at least four load-bearing bands; each of the four load-bearing bands respectively housed in each of the four sheaths and attached to the lattice at respective intersection points.

The bulkhead liner can include at least two reinforcement webs attached to respective edges of the pliable body located near a rear door of the shipping container. The reinforcement webs can be aligned parallel with the edges of the pliable body to reinforce its edges. Additional reinforcement webs can be attached along all horizontal and vertical edges or other stress areas of the pliable body. At least some of the straps of the lattice can be attached to the reinforcement webs to reinforce attachment of the lattice to the exterior surface.

The bulkhead liner can include at least one locking strap having a first end and a second end. The first end is attached to the reinforcement web or to the load-bearing strap. The second end is attached to a shipping container tie-down.

The bulkhead liner can include at least one discharge aperture through the exterior and interior surfaces for discharging the product from the cavity.

In another aspect of the invention, a container system is provided with a container having an interior and a door for separating the interior from an external environment. A bulkhead liner is attached in the interior of the container. The bulkhead liner has an exterior surface and an interior surface forming a cavity therein. At least one loading aperture is formed through the exterior and interior surfaces for loading a product in the cavity. The exterior surface is complementary to a shape of the interior of the container when the bulkhead liner is filled with the product.

A lattice is attached to the exterior surface in this aspect. The lattice includes a number of straps with at least one upper support strap and at least one lower support strap to counteract an expansion force exerted by the product in the cavity. At least one sheath is affixed to the interior surface of the bulkhead liner, and at least one load-bearing band is contained in the sheath such that the load-bearing band is separate from the product. The sheath and the load-bearing band are not attached to each other so that when the expansion force is imparted by the product, the sheath and the load-bearing band do not tear apart and contaminate the product as the load-bearing band, which is attached to a portion of the lattice, further counteracts the expansion force exerted by the product in the cavity.

The straps are attached to the exterior surface near the door. The straps and the load-bearing band thus prevent the exterior surface from contacting the door when the bulkhead liner is filled with the product.

Also in this aspect, the sheath is sealed to the interior surface at an intersection point with the load-bearing band. Alternatively, the sheath is sealed between the exterior and interior surfaces. The sheath extends away from the interior surface through the exterior surface. The sheath has a termination opening through which the load-bearing band extends for attachment of the load-bearing band to a tie-down in the container. In this aspect of the invention, respective termination openings of the sheaths are spaced ten to fifteen inches from respective tie-downs in the container. This arrangement prevents the liner from shifting out of the container.

In one embodiment, at least four sheaths and at least four load-bearing bands are provided. Each of the four load-bearing bands extends through each of the four sheaths. The four load-bearing bands are attached at respective intersection points to respective straps.

According to yet another aspect of the invention, a method of utilizing a bulkhead liner in a shipping container is provided. One step in the method is providing a pliable body having an exterior surface, an interior surface defining a cavity therein, at least one sheath disposed proximate the interior surface, at least one load-bearing band disposed in the sheath, a lattice affixed to the exterior surface, and a plurality of locking straps depending from the lattice for attachment in a shipping container. Similar to the previous embodiments, at least one loading aperture is formed through the exterior surface and the interior surface.

Further steps of the method include inserting the pliable body in the interior of the shipping container; attaching the plurality of locking straps to a plurality of tie-downs disposed in the shipping container; and attaching the load-bearing band extending from the sheath though the exterior surface to at least one of the plurality of tie-downs.

The method also includes the step of loading a product into the cavity via the loading aperture. As the product is loaded, the lattice and the load-bearing band resist an expansion force exerted by the product in the cavity. As noted above, the load-bearing band should be movable in the sheath to prevent damage to the sheath and the pliable body and contamination to the product.

The method further includes the step of unloading the product from the cavity. During this step, the lattice and the load-bearing band resist a dynamic force exerted by the unloading product.

BRIEF DESCRIPTION OF THE DRAWINGS

Further aspects and advantages of the invention will be apparent from the following description, or can be learned through practice of the invention, in combination with the drawings in which.

DETAILED DESCRIPTION OF THE INVENTION

Figure 1:
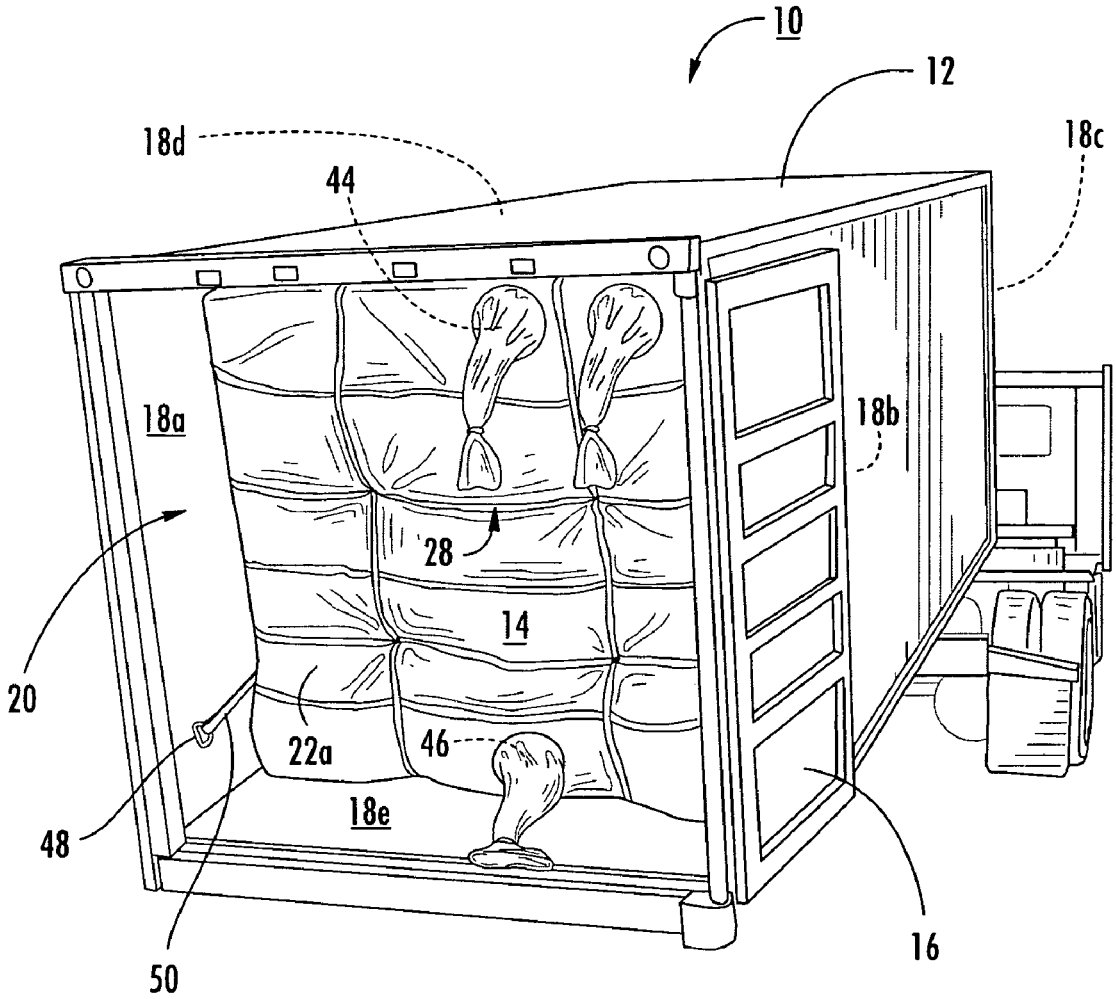
FIG. 1 is a perspective view of a braceless liner for a shipping container according to an aspect of the invention.

Detailed reference will now be made to the drawings in which examples embodying the present invention are shown. The detailed description uses numerical and letter designations to refer to features of the drawings. Like or similar designations of the drawings and description have been used to refer to like or similar parts of the invention.

The drawings and detailed description provide a full and written description of the invention, and of the manner and process of making and using it, so as to enable one skilled in the pertinent art to make and use it, as well as the best mode of carrying out the invention. However, the examples set forth in the drawings and detailed description are provided by way of explanation only and are not meant as limitations of the invention. The present invention thus includes any modifications and variations of the following examples as come within the scope of the appended claims and their equivalents.

A container system is broadly embodied in the figures, generally designated by element number 10. The container system 10 is used to transport or store cargo or a product such as grains, dry chemicals, or other dry bulk cargo, designated herein by the letter "P". The container system 10 prevents contamination of the product P, provides for shipping and storage of the product P, and resists various forces imparted or exerted by the product P during its loading, shipping, storage and unloading as will be described in detail below.

As the figures generally show, the container system 10 includes a shipping container 12 and a bulkhead liner or liner body 14 (also referred to herein as a pliable or flexible body). The bulkhead liner 14 is inserted in the container 12 in a substantially relaxed state or condition. The bulkhead liner 14 will expand or "inflate" when filled with the product P to take a shape complementary to the container 12. Those skilled in the art will appreciate that the bulkhead liner 14 will therefore assume a square or rectangular shape in many cases, as shown for instance in FIG. 1. However, the bulkhead liner 14 being pliable and flexible can be filled with the product P to assume many other shapes according to different sizes and shapes of various shipping containers.

With particular reference to FIG. 1, the container system 10 is shown with the bulkhead liner 14 installed in an interior space 20 of the container 12. In this example, the container 12 is a rectangularly shaped trailer of the type used on many tractor-trailers. The container 12 has a doorway with a door or doors 16, three internal walls or sides 18*a-c*, a ceiling 18*d* and a floor 18*e*, collectively referred to herein as container surfaces 18*a-e*.

The bulkhead liner 14 shown in FIG. 1 is a pliable, flexible body made from polypropylene, polyethylene, and similar durable, plastic-like materials or combinations of these materials. When the bulkhead liner 14 is filled with the product P (see e.g., FIG. 8), the bulkhead liner 14 occupies most of the interior space 20 of the container 12. However, the bulkhead liner 14 is attached to tie-down points 48, such as D-rings, in the interior space 20 at a distance sufficient to position the bulkhead liner 14 away from the doors 16 to prevent contact with the doors 16 or nearby sharp objects, even when the bulkhead liner 14 is filled to capacity and tilted toward the doors 16.

FIG. 1 further shows an exterior surface or face 22*a* of the bulkhead liner 14, a lattice 28 attached to the exterior surface 22*a*, a loading spout and aperture 44, and a discharge membrane and aperture 46. These and other elements, components, and characteristics of the bulkhead liner 14 are described in detail and by way of example operation below.

Figure 2:
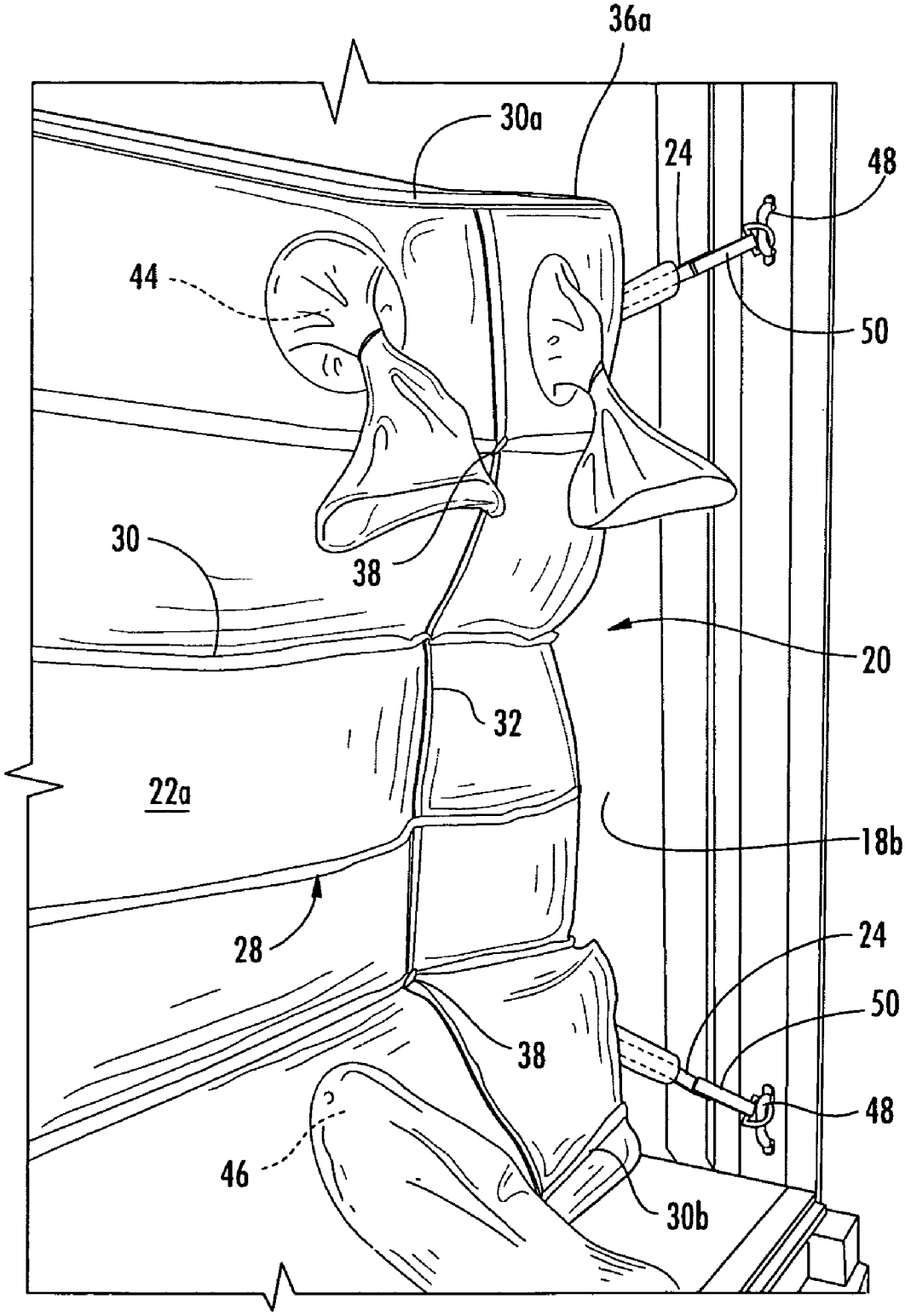
FIG. 2 is a perspective view of a portion of the braceless liner as in FIG. 1.

FIG. 2 shows a portion of the bulkhead liner 14 installed in the interior 20 of the container 12. As briefly introduced above, the bulkhead liner 14 includes the lattice 28 attached to the exterior surface 22*a* of the bulkhead liner 14. The skilled artisan will instantly appreciate that the lattice 28 can be attached over substantially all of the exterior surface 22*a* of the bulkhead liner, including in a direction of the side 18*c* and the ceiling 18*d* of the shipping container 12 (see FIG. 1).

As shown in FIG. 2, the lattice 28 is formed from a series of horizontally oriented strapping or webbing 30, which are attached to a series of intersecting, vertically oriented strapping or webbing 32. Although the strapping 30,32 are substantially horizontal and vertical in this example, the lattice 28 can have diagonally arranged strapping, or other orientations, in lieu of or in addition to the horizontal and vertical strapping 30,32. Likewise, additional strapping can be used to form the lattice 28 other than the strapping 30,32.

With further reference to FIG. 2, a first support strap 30*a* (also referred to herein as upper or first main support member) and a second support strap 30*b* (also referred to herein as lower or second main support member) are attached to respective upper and lower areas of the exterior surface 22*a*, for instance at a horizontal edge 36*a* of the bulkhead liner 14. As described below, these main support members 30*a,b* serve to reinforce certain stress points of the bulkhead liner 14. The main support members 30*a,b*, as well as the remainder of the strapping 30,32, are made of a synthetic fabric such as nylon, although any durable synthetic or metallic material can be used.

FIG. 2 particularly shows that the horizontal and vertical strapping 30,32 intersect at a plurality of intersection points 38. These intersection points 38 are formed by a thread such as nylon, although any durable, synthetic or metallic material can be used. The intersection points 38 also attach one or more internal, reinforcing straps or bands 24 to the horizontal and vertical strapping 30,32. These bands 24 are described below with respect to FIG. 4.

FIG. 2 also shows one of a plurality of locking straps 50. These locking straps 50 can be inelastic or partially extensible. Further, the locking straps 50 can extend from the exterior surface 22*a* of the bulkhead liner 14 to one of the tie-down points 48 on the container surfaces 18*a-e* of the container 12. Alternatively or additionally, one or more of the locking straps 50 can extend from one or more of the tie-down points 48 and tie-off to one of the reinforcing bands 24, as shown in this example. Specifically, a portion of the internal band 24 shown here projects from a void or cavity of the bulkhead liner 14 and is secured to the tie-down point 48 via the locking strap 50.

Figure 3:
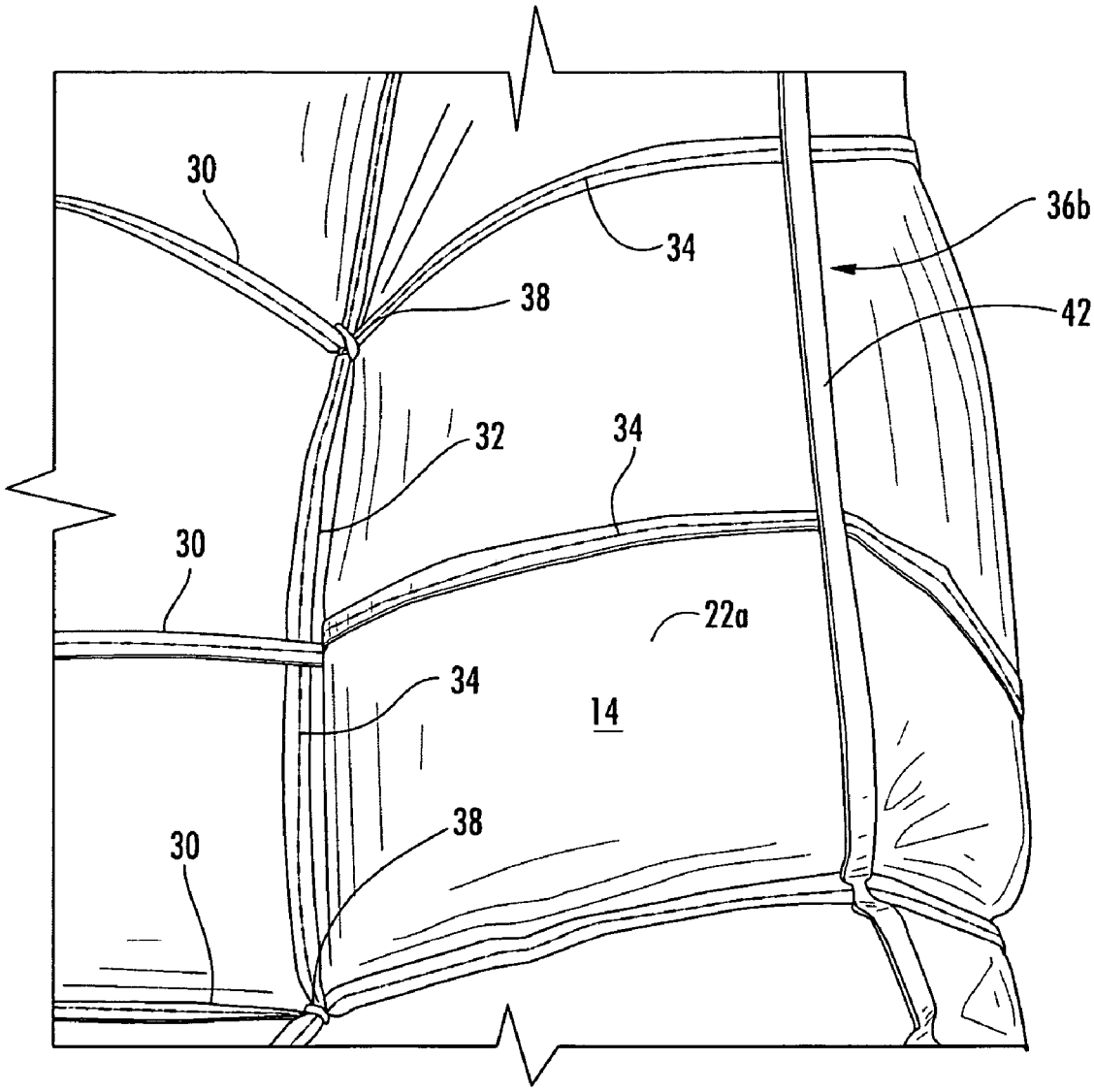
FIG. 3 is a partial view of the braceless liner as in FIG. 1.

FIG. 3 shows the horizontal and vertical strapping 30, 32 attached to the external surface 22*a* via stitching 34 and intersecting at the intersection points 38. As shown, the horizontal strapping 30 extends under a reinforcement web 42 and around the bulkhead liner 14 in the direction of the side 18*c* of the shipping container 12. The reinforcement web 42 is affixed along a vertical edge 36*b* of the bulkhead liner 14 to assist the horizontal strapping 30 in countering an expansion force from the product P exerted in this area of the bulkhead liner 14. Like components of the lattice 28, the reinforcement web 42 is made of a synthetic fabric such as nylon, although any durable synthetic or metallic material can be used. Additionally, due to its reinforcing position along the vertical edge 36*b*, the reinforcement web 42 can be made wider and thicker than the horizontal and vertical strapping 30, 32.

Figure 4:
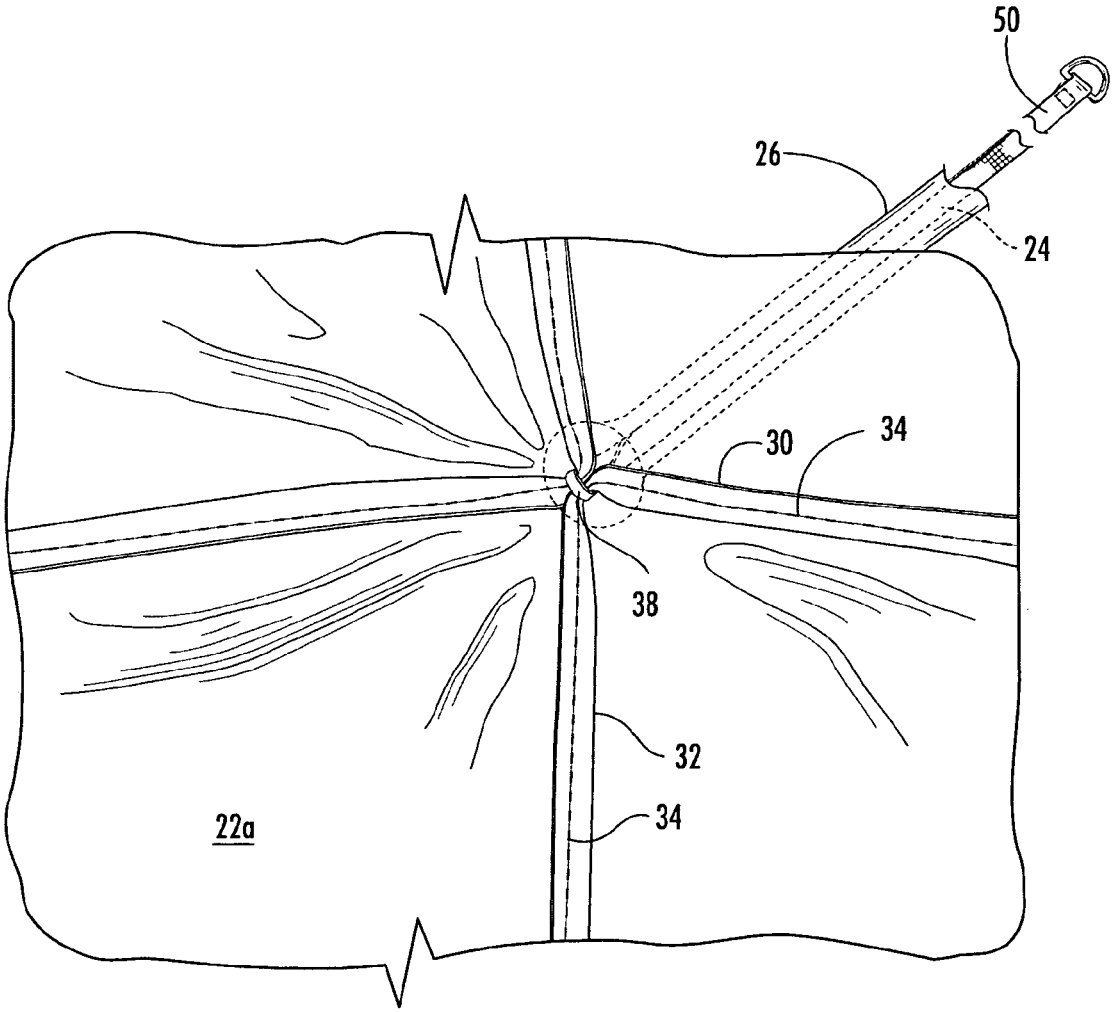
FIG. 4 is a detailed view of a portion of a liner lattice attached to a reinforcing band according to another aspect of the invention.

FIG. 4 shows most clearly the horizontal and vertical strapping 30, 32 overlapping and secured to each other at one of the intersection points 38. In this detailed view, one of the internal reinforcing bands 24 is also attached to the horizontal and vertical strapping 30. The reinforcing band 24 extends inwardly from the intersection point 38 to buttress the horizontal and vertical strapping 30, 32 against the expansion force of the product P. As noted above with respect to FIG. 2, the reinforcing band 24 is attached either directly to a tie-down point 48 or via one of the locking straps 50.

FIG. 4 also shows the reinforcing band 24 shrouded in a sheath 26 (also referred to as casing, shroud, sleeve, tube, or tubing) to protect the product P from contamination by the reinforcing band 24. In this example, the sheath 26 is polyethylene tubing, although other plastic-like or impermeable materials can be utilized. The reinforcing band 24 and the sheath 26 are not attached to each other to prevent tearing the sheath 26 when the reinforcing band 24 reacts to the expansion force from the product P, discussed further below.

Figure 5:
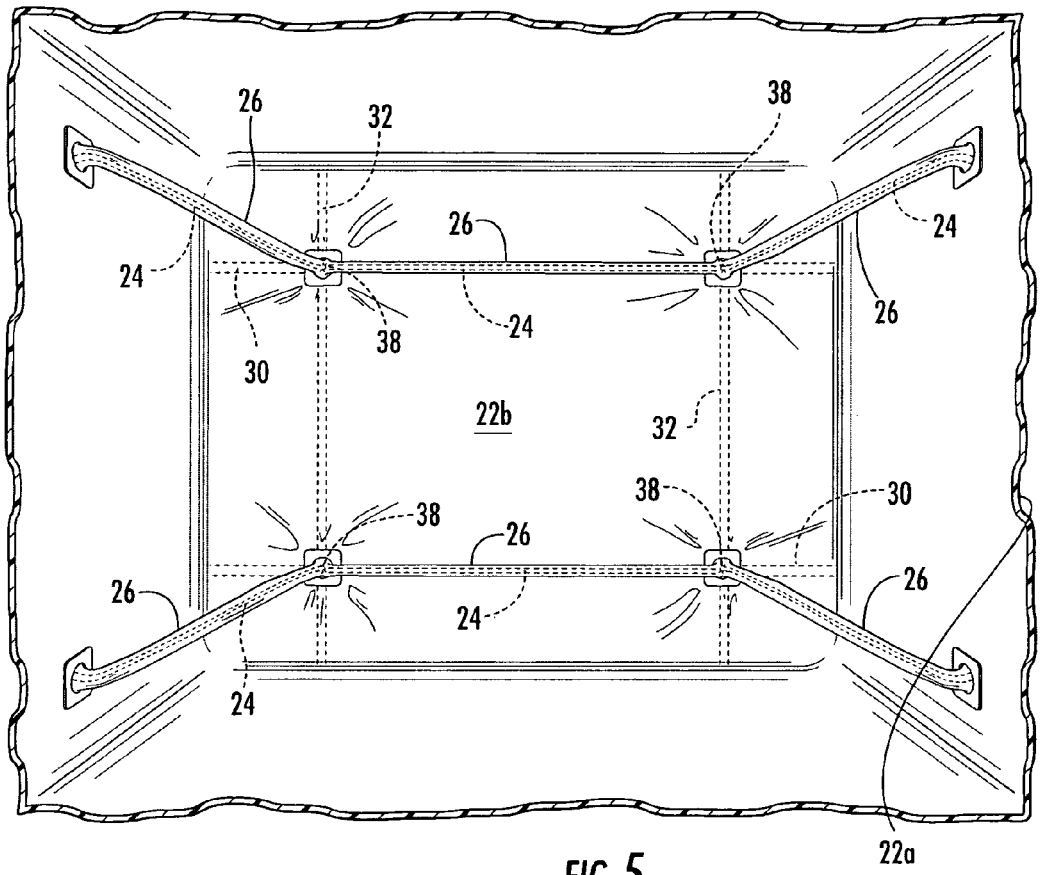
FIG. 5 is an internal view of a braceless liner according to another aspect of the invention.
Figure 6:
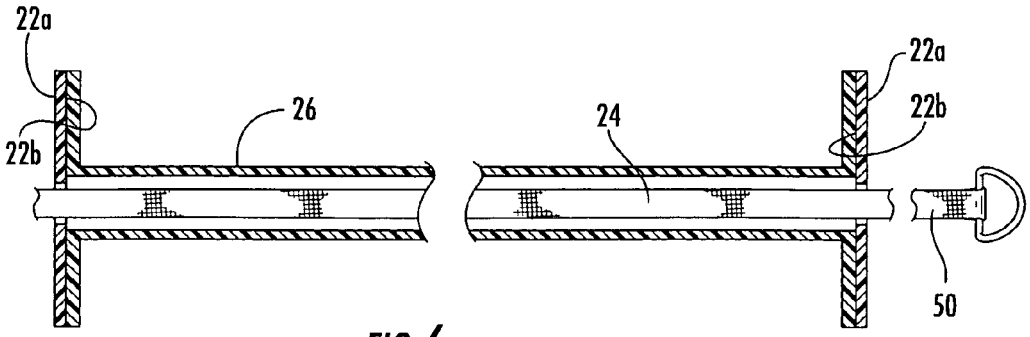
FIG. 6 is a partial cross sectional view of a reinforcing band in a sheath as in FIG. 5.

FIGS. 5 and 6 show the exterior face 22*a* and an interior surface or face 22*b* of the bulkhead liner 14. The reinforcing band 24 is encased in the sheath 26, which runs the length of the reinforcing band 24 to protect the product P (omitted in FIG. 5 for clarity) from contamination by the reinforcing band 24 or from outside contaminants that can attach themselves to the reinforcing band 24. With brief reference once more to FIGS. 2 and 4, at least a portion each of the reinforcing band 24 and the sheath 26 can extend through the interior face 22*b* to further shield the product P from contamination. Preferably but without limitation, the sheath 26 loosely encases the reinforcing band 24 so that when the product P presses against the interior face 22*b*, the sheath 26 yields to the action-reaction of the product P and the reinforcing band 24. Alternatively stated, the sheath 26 includes sufficient excess material and flexibility to stretch some length to accommodate any expansion of the bulkhead liner 14.

Figure 7:
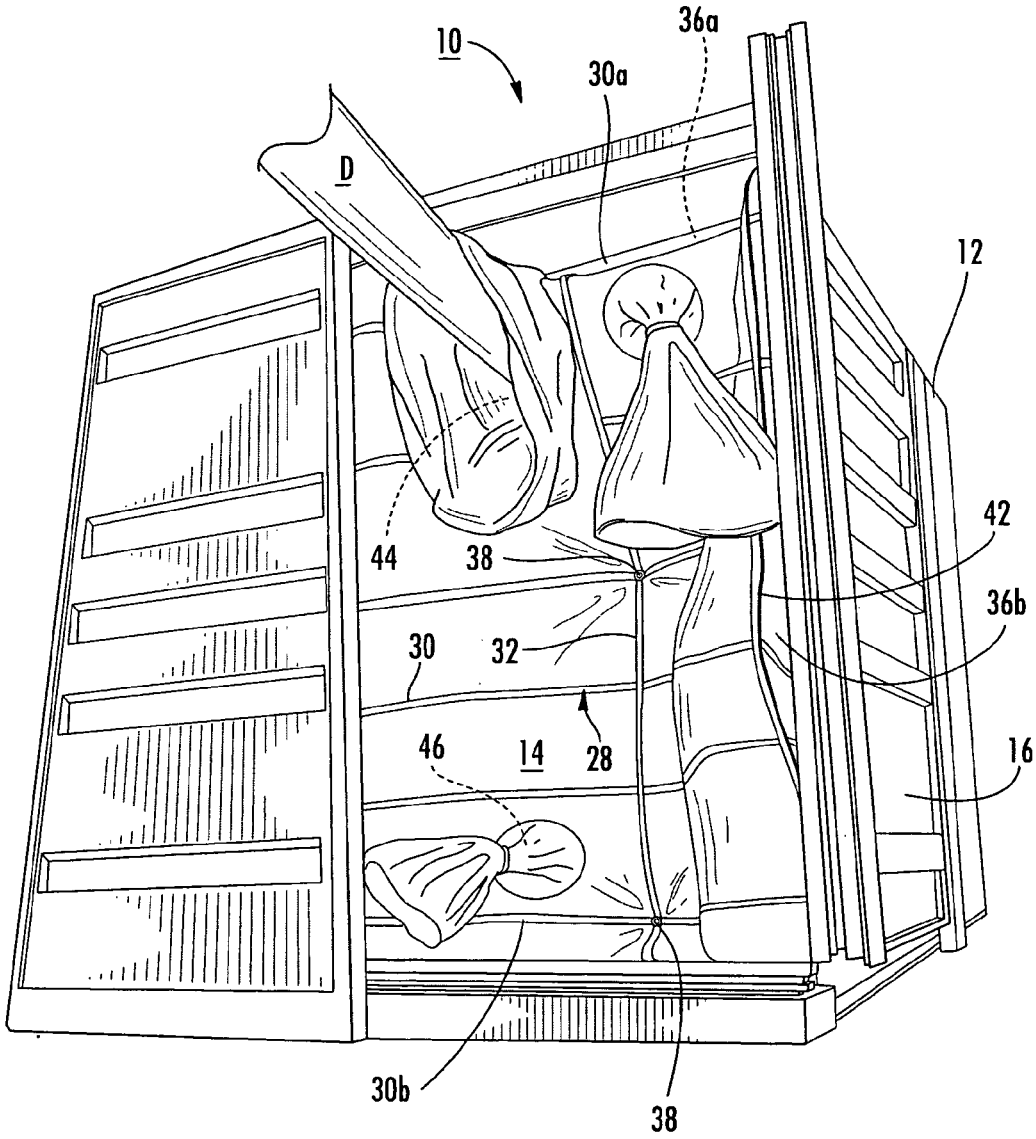
FIG. 7 is a perspective view showing a step according to a method of the invention.

FIG. 7 shows the bulkhead liner 14 in use. A loading device D attached to a grain elevator (not shown) or the like is inserted in the loading aperture 44 of the bulkhead liner 14. The bulkhead liner 14 is secured within the container 12 via the reinforcing bands 24 and the locking straps 50 to the tie-down points 48 within the container 12. Thus, the bulkhead liner 14, though in a relaxed state before receiving the product P, approximates the shape of the shipping container 12. As the product P fills the bulkhead liner 14, the lattice 28—in particular the main support members 30*a*, 30*b*—the reinforcing band 24 via the intersection points 38, and the reinforcement web 42 resist the expansion force of the product P. Specifically, these components serve to brace and strengthen the bulkhead liner 14 along various stress points.

Figure 8:
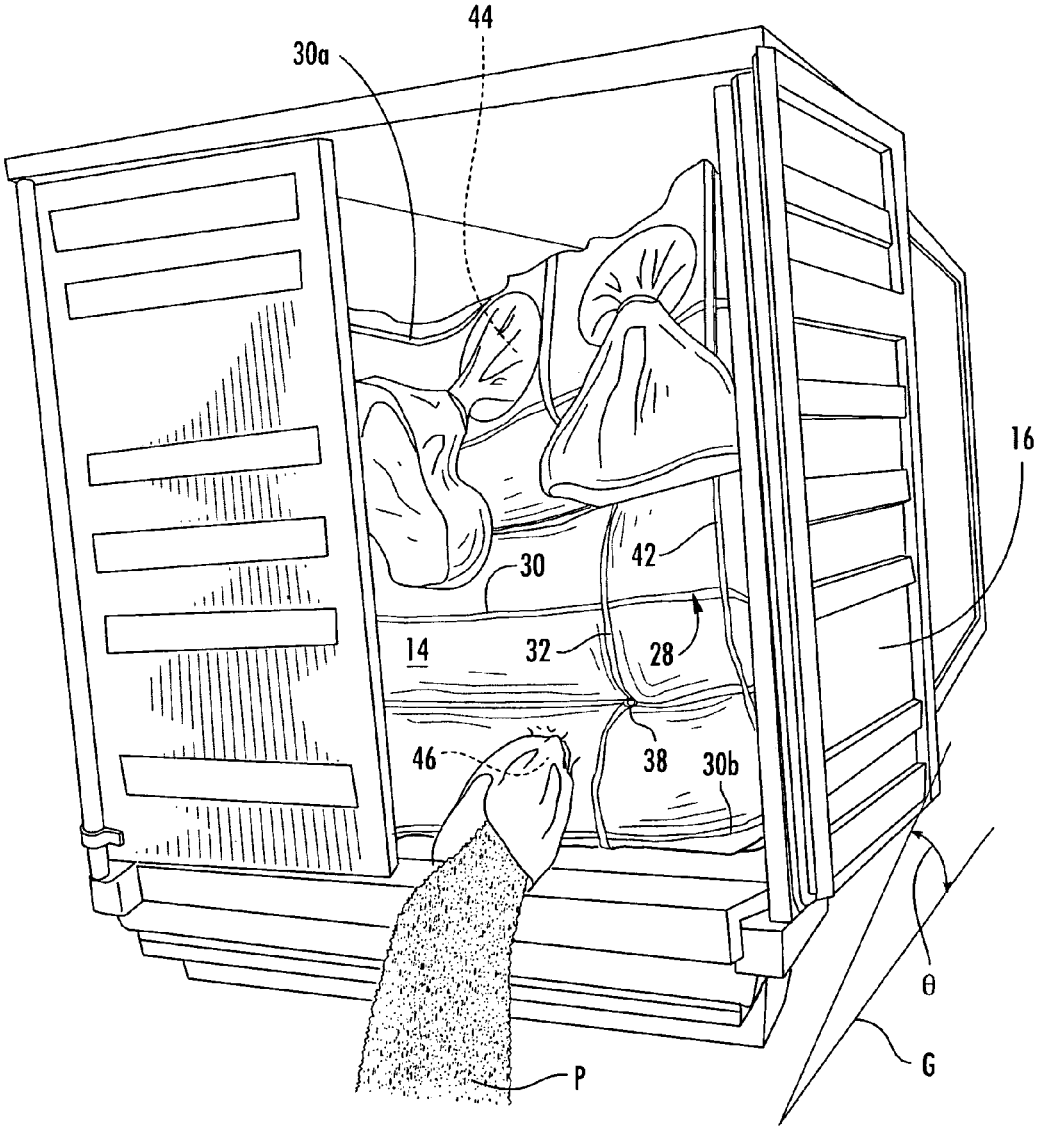
FIG. 8 is a perspective view showing another step according to a method of the invention.

FIG. 8 shows another use of the bulkhead liner 14. Stress exerted by the product P is shown clearly in vicinities of the lower main support member 30*b*, the intersection points 38, and the reinforcement web 42. As the shipping container is tilted upwards from the ground G indicated by angle Θ, the lattice 28, particularly the horizontal and vertical strapping 30, 32 and the reinforcement web 42, cooperate to resist or counteract the stress and expansion forces of the product P. Specifically, as the container 12 is tilted at angle Θ, the product P shifts toward the door 16 and exacerbates the expansion forces imparted by the product P against the interior surface 22*b* of the bulkhead liner 14 (see FIG. 5).

FIG. 8 further shows a discharge aperture 46 opened in the bulkhead liner 14 to allow the product P to discharge. The internal straps 24 in combination with the lattice 28 and intersection points 38 and reinforcement web 42 prevent susceptible areas of the bulkhead liner 14 from tearing or rupturing as the product P shifts to unload from the bulkhead liner 14. As noted with respect to FIG. 1, the bulkhead liner 14 is located some distance inside the interior space 20 of the container 12 due to the spacing of the locking straps 50 to the tie-down points 48. More specifically, additional reinforcement bands 24 and/or locking straps 50 can be attached to the bulkhead liner 14 and the container surfaces 18*a-e* in an area of the wall 18*c* to prevent the bulkhead liner 14 from sliding out of the shipping container 12. Thus, the shifting product P is prevented from shifting the bulkhead liner 14 against the door 16 of the container 12, which could damage the bulkhead liner 14.

The above and other aspects may be better understood with reference to an operation of a container system according to an exemplary method of the invention. The method utilizes a pliable body 14 in a shipping container 12 similar to the embodiments described above. Thus, general steps in the method are described below with reference to the foregoing embodiments for enabling details.

As shown in FIGS. 7 and 8, the method of utilizing the container system 10 includes the steps of providing the pliable body 14 with an exterior surface 22*a* and an interior surface 22*b* defining a void or cavity within the pliable body 14. The lattice 28, substantially as described above, is attached to the exterior surface 22*a*. At least one sheath 26 is located near and/or attached to the interior surface 22*b* and at least one load-bearing band 24, e.g., four load bearing bands 24, is located within the sheath 26.

The pliable body 14 is inserted in an interior space 20 of a shipping container 12. Locking straps 50 extend from the lattice 28 and are attached to tie-down points 48 in the interior space 20 of the container 12. The four load bearing bands 24 are attached to four points intersecting the horizontal and vertical straps 30 and 32 of the lattice 28 at intersection points 38 to withstand compression and expansion forces of the product P. Additionally, the load bearing bands extend at least 12 inches from the external surface 22*a* of the liner 14 and—like the locking straps 50—are attached to tie-down points 48 within the interior space 20 of the container 12.

The product P such as corn or other dry bulk material is inserted into the cavity of the liner 14 via the loading aperture 44. As the product P fills the cavity of the liner 14, the lattice 28 and in particular the internal bands 24 intersecting the horizontal and vertical strapping 30, 32 at intersection points 38 as well as the upper and lower main support members 30*a*, 30*b* and the reinforcing web 42 act in concert to resist the weight, gravity and expansion forces created by the product P. The bands 24 are isolated from the product P to prevent contamination of the product P and are freely movable within their respective sheaths 26 to prevent internal damage to the liner 14. Finally, once the product P has reached its destination, the discharge aperture 46 such as a membrane is opened to release the product P from the bulkhead liner 14. As the shipping container 12 is tilted, the compression and expansion forces of the shifting product P press against the bulkhead liner 14. Again, the lattice 28, the intersecting internal bands 24, the main support members 30*a*, 30*b* and the reinforcing web 42 operate in concert to prevent tears or ruptures at stress points in the bulkhead liner 14.

While preferred embodiments of the invention have been shown and described, those skilled in the art will recognize that other changes and modifications may be made to the foregoing examples without departing from the scope and spirit of the invention. For instance, various durable, reusable materials can be used for the liner body 14 and various durable and strong synthetic materials nylon can be used for the various straps described herein. Additionally, although the examples shown and described are substantially horizontal and vertical, the lattice 28, for instance, can be diagonally arranged and have various other criss-cross patterns other than those shown and described. Furthermore, additional straps can be used to form the lattice 28 other than the number of straps shown and described herein. Likewise, numerous internal bands 24 can be used and attached to the lattice 28 at numerous other intersection points other than those intersection points 38 shown and described. It is intended to claim all such changes and modifications as fall within the scope of the appended claims and their equivalents.

Moreover, references herein to "top," "upward," "upper," "higher," "lower," "bottom," "downward," "descending," "ascending," "side," "first," and "second," structures, elements, designations, geometries and the like are intended solely for purposes of providing an enabling disclosure and in no way suggest limitations regarding the operative orientation or order of the exemplary embodiments or any components thereof.

That which is claimed is:

1. A bulkhead liner for a shipping container, comprising:

a pliable body having an exterior surface and an interior surface defining a cavity therein, the exterior surface and the interior surface having at least one loading aperture therethrough for loading a product in the cavity, the exterior surface of the pliable body complementary to a shipping container shape when filled with the product;

a lattice affixed to the exterior surface to resist an expansion force exerted by the product in the cavity;

at least one sheath disposed inside the interior surface of the pliable body; and at least one load-bearing band disposed in the at least one sheath such that the at least one load-bearing band is spaced apart from the product, the at least one load-bearing band attached to the lattice to further resist the expansion force exerted by the product in the cavity.

2. The bulkhead liner as in claim 1, wherein the pliable body is made from a material selected from the group consisting of polypropylene and polyethylene.

3. The bulkhead liner as in claim 1, wherein the pliable body has a capacity of 20 to 50 cubic feet when filled with the product.

4. The bulkhead liner as in claim 1, wherein the lattice and the load-bearing band are made of a synthetic fabric.

5. The bulkhead liner as in claim 4, wherein the synthetic fabric is nylon.

6. The bulkhead liner as in claim 1, wherein the lattice is a plurality of straps attached substantially horizontally, vertically, diagonally, or combinations thereof to the exterior surface.

7. The bulkhead liner as in claim 6, wherein the plurality of straps is attached to the exterior surface proximate a shipping container doorway.

8. The bulkhead liner as in claim 1, wherein the at least one sheath is made from polyethylene.

9. The bulkhead liner as in claim 1, wherein the at least one sheath is sealed between the exterior and interior surfaces.

10. The bulkhead liner as in claim 9, wherein the at least one sheath depends from the exterior surface, the at least one sheath defining a termination opening therein, the at least one load-bearing band extending through the termination opening away from the interior surface for attachment of the at least one load-bearing band to a shipping container tie-down.

11. The bulkhead liner as in claim 1, further comprising at least four sheaths and at least four load-bearing bands, each of the four load-bearing bands respectively disposed in each of the four sheaths and attached to the lattice at respective intersection points.

12. The bulkhead liner as in claim 1, further comprising at least two reinforcement webs attached to respective edges of the pliable body, wherein the lattice includes a plurality of straps attached to the at least two reinforcement webs to reinforce attachment of the lattice to the exterior surface.

13. The bulkhead liner as in claim 12, wherein the at least two reinforcement webs and respective edges of the pliable body are aligned substantially vertically.

14. The bulkhead liner as in claim 12, further comprising at least one locking strap having a first end and a second end, the first end attached to at least one of the reinforcement webs and the second end attached to a shipping container tie-down.

15. The bulkhead liner as in claim 1, wherein the exterior surface and the interior surface have at least one discharge aperture therethrough for discharging the product from the cavity.

16. A container system, comprising:

a container defining an interior therein and a door for separating the interior from an external environment;

a bulkhead liner attached in the interior of the container, the bulkhead liner having an exterior surface and an interior surface defining a cavity therein, the exterior surface and the interior surface having at least one loading aperture therethrough for loading a product in the cavity, the exterior surface complementary to a shape of the interior of the container when the bulkhead liner is filled with the product;

a lattice affixed to the exterior surface, the lattice having a plurality of straps including at least one upper support strap and at least one lower support strap spaced apart from each other to counteract an expansion force exerted by the product in the cavity;

at least one sheath disposed inside the interior surface of the bulkhead liner; and at least one load-bearing band disposed in the at least one sheath such that the at least one load-bearing band is spaced apart from the product, the at least one load-bearing band attached to the lattice to further counteract the expansion force exerted by the product in the cavity.

17. The container system as in claim 16, wherein the bulkhead liner is made from a pliable material selected from the group consisting of polypropylene and polyethylene.

18. The container system as in claim 16, wherein the plurality of straps of the lattice is attached substantially horizontally, vertically or diagonally to the exterior surface.

19. The container system as in claim 16, wherein the plurality of straps is attached to the exterior surface proximate the door, the plurality of straps and the at least one load-bearing band preventing the exterior surface from contacting the door when the bulkhead liner is filled with the product.

20. The container system as in claim 16, wherein the at least one sheath is sealed to the interior surface at an intersection point with the at least one load-bearing band.

21. The container system as in claim 16, wherein the at least one sheath is sealed between the exterior and interior surfaces.

22. The container system as in claim 16, wherein the at least one sheath depends away from the interior surface through the exterior surface, the at least one sheath defining a termination opening therein, the at least one load-bearing band extending through the termination opening for attachment of the at least one load-bearing band to a tie-down in the container.

23. The container system as in claim 22, wherein the termination opening of the at least one sheath is spaced ten to fifteen inches from the tie-down in the container.

24. The container system as in claim 16, further comprising at least four sheaths and at least four load-bearing bands, each of the four load-bearing bands respectively disposed in each of the four sheaths and attached at respective intersection points to respective ones of the plurality of straps.

25. The container system as in claim 16, further comprising at least two reinforcement webs attached to respective edges of the bulkhead liner, the plurality of straps of the lattice attached to the at least two reinforcement webs to reinforce attachment of the lattice to the exterior surface.

26. The container system as in claim 16, wherein the exterior surface and the interior surface have at least one discharge aperture therethrough for discharging the product from the cavity.

* * * * *